US008281506B2

(12) United States Patent
Stefek et al.

(10) Patent No.: US 8,281,506 B2
(45) Date of Patent: Oct. 9, 2012

(54) TOOL COUPLER ASSEMBLY

(75) Inventors: Trent Randall Stefek, Manhattan, KS (US); Troy Curtis Robl, Manhattan, KS (US)

(73) Assignee: Caterpillar Inc., Peoria, IL (US)

( * ) Notice: Subject to any disclaimer, the term of this patent is extended or adjusted under 35 U.S.C. 154(b) by 115 days.

(21) Appl. No.: 12/814,853

(22) Filed: Jun. 14, 2010

(65) Prior Publication Data

US 2011/0209608 A1 Sep. 1, 2011

Related U.S. Application Data

(60) Provisional application No. 61/308,610, filed on Feb. 26, 2010.

(51) Int. Cl.
*E02F 3/96* (2006.01)

(52) U.S. Cl. ..... 37/468

(58) Field of Classification Search ..... 37/403–410, 37/468, 466; 172/272; 414/723, 724; 91/1, 91/420, 432

See application file for complete search history.

(56) References Cited

U.S. PATENT DOCUMENTS

| | | | | |
|---|---|---|---|---|
| 5,147,173 | A | 9/1992 | Fauber et al. | |
| 5,966,850 | A * | 10/1999 | Horton | 37/468 |
| 6,260,357 | B1 | 7/2001 | Goodfellow et al. | |
| 6,422,805 | B1 | 7/2002 | Miller | |
| 6,481,124 | B1 | 11/2002 | Miller et al. | |
| 6,625,909 | B1 | 9/2003 | Miller et al. | |
| 6,902,346 | B2 | 6/2005 | Steig, Jr. et al. | |
| 7,047,866 | B2 | 5/2006 | Fatemi et al. | |
| 7,367,256 | B2 | 5/2008 | Fatemi et al. | |
| 7,430,955 | B2 | 10/2008 | Bitter | |
| 7,984,575 | B2 * | 7/2011 | Robl et al. | 37/468 |
| 2009/0007465 | A1 | 1/2009 | Robl et al. | |

FOREIGN PATENT DOCUMENTS

| | | |
|---|---|---|
| EP | 1318242 | 6/2003 |
| JP | 09209391 | 8/1997 |
| JP | 10082066 | 3/1998 |
| JP | 11181819 | 7/1999 |
| JP | 2000001872 | 1/2000 |

* cited by examiner

*Primary Examiner* — Robert Pezzuto
(74) *Attorney, Agent, or Firm* — Finnegan, Henderson, Farabow, Garrett & Dunner LLP

(57) ABSTRACT

A tool coupler assembly for a machine. The tool coupler assembly may have a coupler frame, a first latch, a second latch, and a hydraulic actuator connected to move the second latch relative to the first latch and the coupler frame. The hydraulic actuator may have a first chamber, a second chamber, and a pressure valve with a check element movable to allow a flow of fluid into the first chamber based on a pressure of fluid in the first chamber, and a pressure regulating element movable to allow a flow of fluid out of the first chamber based on a pressure of fluid in the second chamber. The tool coupler assembly may additionally have a first pilot passage configured to communicate fluid from the second chamber with the pressure-regulating element, and a second pilot passage configured to communicate fluid from the first chamber with the pressure-regulating element.

18 Claims, 6 Drawing Sheets

TOOL COUPLER ASSEMBLY

RELATED APPLICATIONS

This application is based on and claims the benefit of priority from U.S. Provisional Application No. 61/308,610 by Trent Randall Stefek and Troy Curtis Robl, filed Feb. 26, 2010, the contents of which are expressly incorporated herein by reference.

TECHNICAL FIELD

The present disclosure relates generally to a tool coupler assembly and, more particularly, to a coupler assembly for interchangeably mounting different tools on a single host machine.

BACKGROUND

Machines, for example backhoes, excavators, graders, and loaders, commonly have linkage that is movable to control the motion of a connected tool such as a bucket, a blade, a hammer, or a grapple. When equipped with a single tool, these machines become specialized machines that are primarily used for a single purpose. Although adequate for some situations, the single purpose machines can have limited functionality and versatility. A tool coupler assembly can be used to increase the functionality and versatility of a host machine by allowing different tools to be quickly and interchangeably connected to the linkage of the machine.

Tool coupler assemblies are generally known and include a frame connected to the linkage of a machine, and hooks or latches that protrude from the frame. The hooks of a tool coupler assembly engage corresponding pins of a tool to thereby connect the tool to the linkage. To help prevent undesired disengagement of the hooks from the pins, tool coupler assemblies can be equipped with a hydraulic piston that locks the hooks in place against the pins.

When connecting or disconnecting a tool to a host machine, precautions should be taken to help ensure the procedure is performed properly. For example, the tool should be in a desired resting position before decoupling is performed so that the tool does not move in an unexpected manner after the decoupling. In addition, fluid provided to the hydraulic piston of the tool coupler assembly should be at a pressure that allows proper operation of the tool coupler assembly without causing damage to the assembly.

The tool coupler assembly of the present disclosure addresses one or more of the needs set forth above and/or other problems of the prior art.

SUMMARY

One aspect of the present disclosure is directed to a tool coupler assembly. The tool coupler assembly may include a coupler frame, a first latch connected to the coupler frame, and a second latch connected to the coupler frame. The tool coupler assembly may also include a hydraulic actuator connected to move the second latch relative to the first latch and the coupler frame. The hydraulic actuator may have a first chamber, a second chamber separated from the first chamber, a first port in fluid communication with the first chamber, and a second port in fluid communication with the second chamber. The tool coupler assembly may further include a pressure valve having a check element movable to allow a flow of fluid into the first chamber via the first port based on a pressure of fluid in the first chamber, and a pressure-regulating element movable to allow a flow of fluid out of the first chamber via the first port based on a pressure of fluid in the second chamber. The tool coupler assembly may additionally have a first pilot passage configured to communicate fluid from the second chamber with the pressure-regulating element to move the pressure-regulating element, and a second pilot passage configured to communicate fluid from the first chamber with the pressure-regulating element to move the pressure-regulating element.

Another aspect of the present disclosure is directed to a machine. The machine may include a base frame, linkage movable relative to the base frame, and a first hydraulic cylinder connected to move the linkage. The machine may also include a tool having a first pin and a second pin, and a tool coupler assembly configured to connect the tool to the linkage. The tool coupler assembly may include a coupler frame, a first latch connected to the coupler frame and configured to engage the first pin of the tool, and a second latch connected to the coupler frame and configured to engage the second pin of the tool. The tool coupler assembly may also include a second hydraulic cylinder connected to move the second latch relative to the first latch and the coupler frame. The tool coupler assembly may further include a control valve configured to selectively direct fluid from the first hydraulic cylinder to the second hydraulic cylinder and from the second hydraulic cylinder to a low pressure reservoir, and a pressure valve configured to allow fluid into and out of the second hydraulic cylinder based on fluid pressures in the second hydraulic cylinder.

Another aspect of the present disclosure is directed to a method of decoupling a tool from linkage of a machine. The method may include directing pressurized fluid to a linkage actuator to move the linkage to an end-stop position, and continuing to direct pressurized fluid to the linkage actuator after the linkage has reached the end-stop position until a pressure of the pressurized fluid has reached a set limit. The method may further include directing pressurized fluid from the linkage actuator to a coupler actuator after the pressure limit has been reached to unlock the tool, and separating the linkage from the tool.

Another aspect of the present disclosure is directed to another method of decoupling a tool from linkage of a machine. This method may include receiving an indication to decouple a tool, and increasing a stroke of a pump for a period of time based on the indication. The method may further include directing fluid pressurized by the pump at an increased stroke to a coupler actuator to hydraulically unlock the coupler actuator, moving the unlocked coupler actuator to unlock the tool, and allowing the linkage to be separated from the tool.

DETAILED DESCRIPTION

Figure 1:
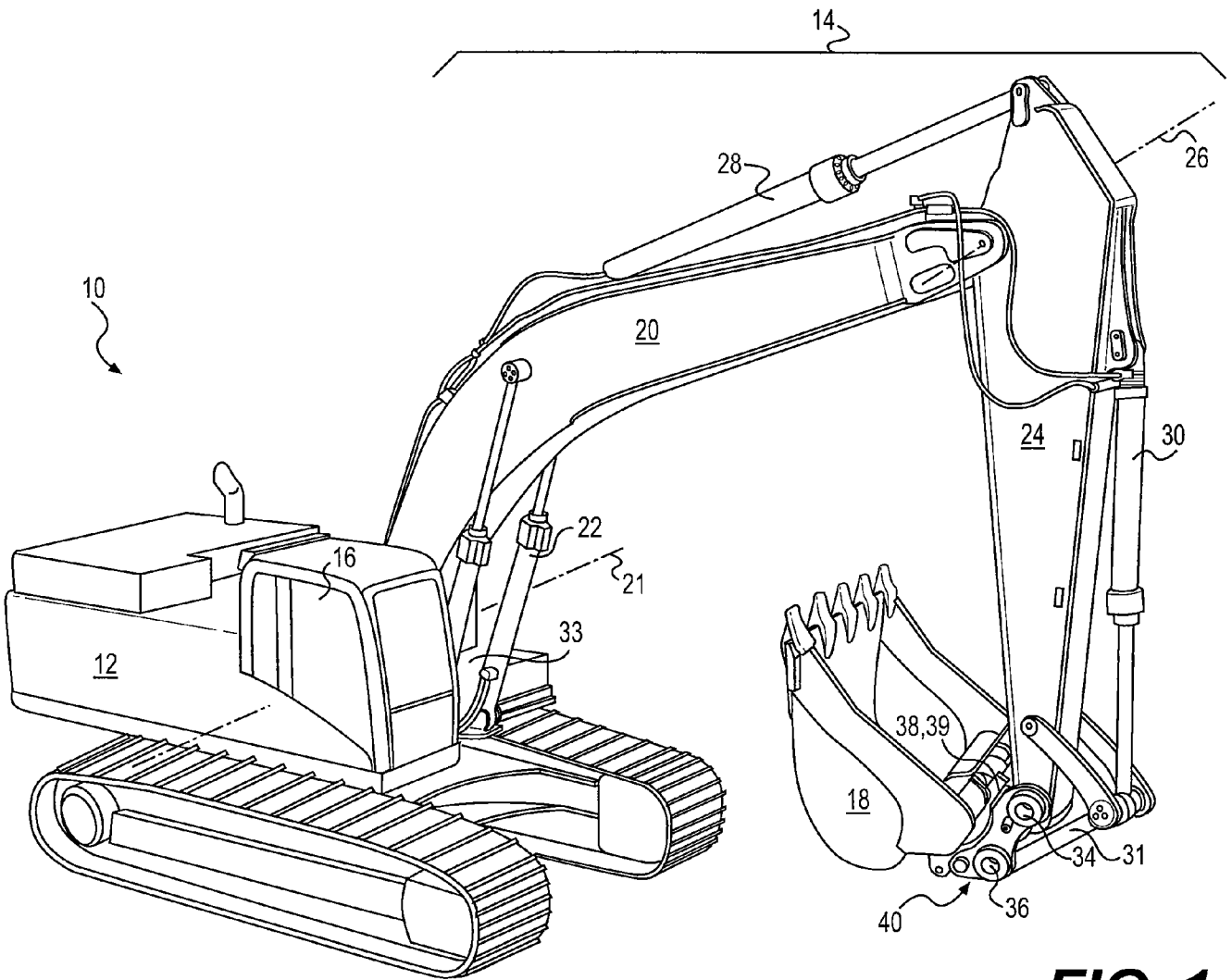
FIG. 1 is a pictorial illustration of an exemplary disclosed machine.

FIG. 1 illustrates an exemplary machine 10. Machine 10 may be a fixed or mobile machine that performs some type of operation associated with an industry, such as mining, construction, farming, transportation, or any other industry known in the art. For example, machine 10 may be an earth moving machine such as an excavator, a backhoe, a loader, or a motor grader. Machine 10 may include a power source 12, a tool system 14 driven by power source 12, and an operator station 16 situated for manual control of tool system 14.

Tool system 14 may include linkage acted on by hydraulic cylinders to move a tool 18. Specifically, tool system 14 may include a boom member 20 that is vertically pivotal about a horizontal boom axis 21 by a pair of adjacent, double-acting, hydraulic cylinders 22, and a stick member 24 that is vertically pivotal about a stick axis 26 by a single, double-acting, hydraulic cylinder 28. Tool system 14 may further include a single, double-acting, hydraulic cylinder 30 that is connected to vertically pivot tool 18 about a tool axis 32. In one embodiment, hydraulic cylinder 30 may be connected at a head-end 30A to a portion of stick member 24, and at an opposing rod-end 30B to tool 18 by way of a power link 31. Boom member 20 may be pivotally connected to a frame 33 of machine 10. Stick member 24 may pivotally connect boom member 20 to tool 18.

Each of hydraulic cylinders 22, 28, and 30 may include a tube portion and a piston assembly arranged within the tube portion to form a head-end pressure chamber and a rod-end pressure chamber. The pressure chambers may be selectively supplied with pressurized fluid and drained of the pressurized fluid to cause the piston assembly to displace within the tube portion, thereby changing the effective length of hydraulic cylinders 22, 28, and 30. The flow rate of fluid into and out of the pressure chambers may relate to a velocity of hydraulic cylinders 22, 28, and 30, while a pressure differential between the head- and rod-end pressure chambers may relate to a force imparted by hydraulic cylinders 22, 28, and 30 on the associated linkage members. The expansion and retraction of hydraulic cylinders 22, 28, and 30 may function to assist in moving tool 18.

Numerous different tools 18 may be attachable to a single machine 10 and controllable via operator station 16. Tool 18 may include any device used to perform a particular task such as, for example, a bucket, a fork arrangement, a blade, a grapple, or any other task-performing device known in the art. Although connected in the embodiment of FIG. 1 to pivot relative to machine 10, tool 18 may additionally rotate, slide, swing, lift, or move in any other manner known in the art. Tool 18 may include fore- and aft-located tool pins 34, 36 that facilitate connection to tool system 14. Tool pins 34, 36 may be joined at their ends by a pair of spaced apart tool brackets 38, 39 that are welded to an external surface of tool 18.

Figure 2:
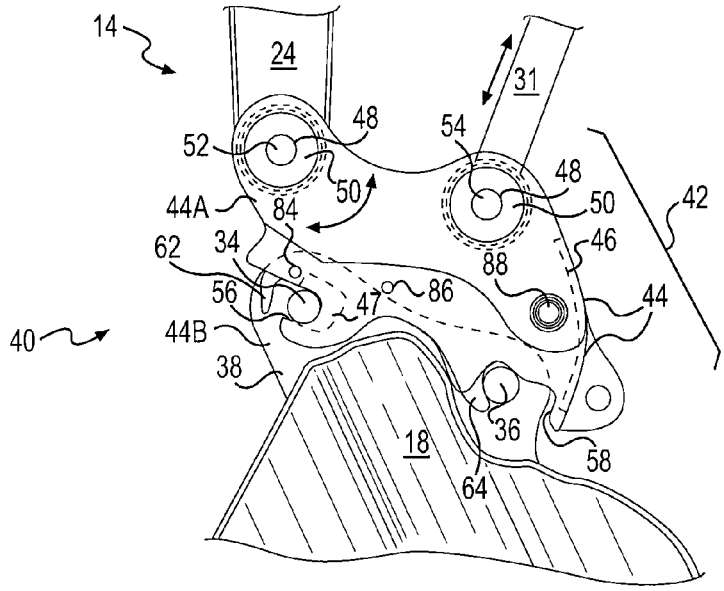
FIG. 2 is a cut-away illustration of an exemplary tool coupler assembly that may be used with the machine of FIG. 1.
Figure 3:
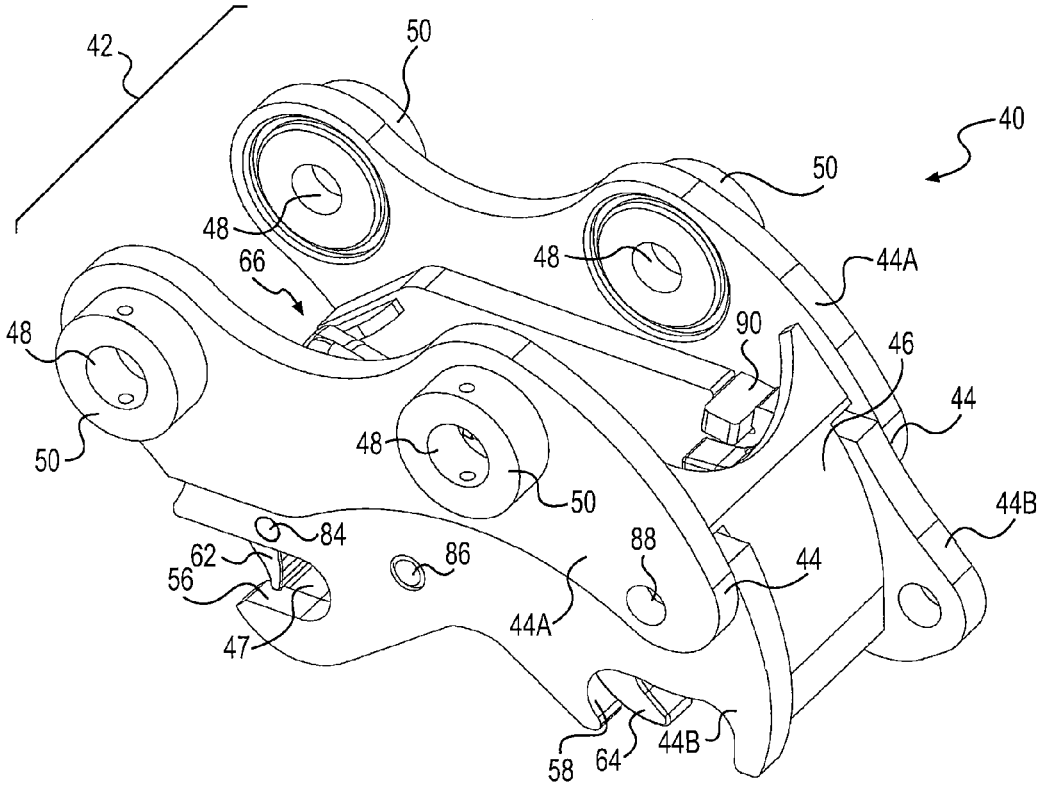
FIG. 3 is a pictorial illustration of the tool coupler assembly of FIG. 2.

A tool coupler assembly 40 may be located to facilitate a quick connection between the linkage of tool system 14 and tool 18. As shown in FIGS. 2 and 3, tool coupler assembly 40 may include a frame 42 having a pair of spaced apart, parallel side plate members 44 (only one shown in FIG. 2) that are interconnected at one end by a cross-plate 46 and at an opposing end by a cross-brace 47. Each side plate member 44 may comprises upper and lower plates 44A, 44B that are horizontally offset from and welded to each other. It will be appreciated, however, that one-piece side plate members may be used instead of the exemplary upper and lower plates 44A, 44B, if desired.

In one embodiment, upper plates 44A may each include two spaced apart pin openings 48, and corresponding collars 50 provided adjacent to each pin opening 48. The pin openings 48 in one upper plate 44A may be substantially aligned with the pin openings 48 in the opposing upper plate 44A, such that a first stick pin 52 of stick member 24 and a second stick pin 54 (removed from FIG. 3 for clarity) of power link 31 may pass therethrough and be retained by side plate members 44. In this manner, extension and retraction of hydraulic cylinder 30 acting through power link 31 and stick pin 54 may function to pivot tool coupler assembly 40 about stick pin 52.

Tool coupler assembly 40 may be detachably connected to tool 18 on a side opposite stick member 24 and power link 31. In the exemplary embodiment, each lower plate 44B may be located inward of tool brackets 38, 39 and include a rear-located, rear-facing notch 56 and a front-located, bottom-facing notch 58. Notches 56 and 58 may be configured to receive tool pins 34 and 36, respectively. Cross-brace 47, located at a front end of side plate members 44, may be shaped to correspond with the shape of notch 56 such that a jaw portion of cross-brace 47 may also receive and support tool pin 34.

Figure 4:
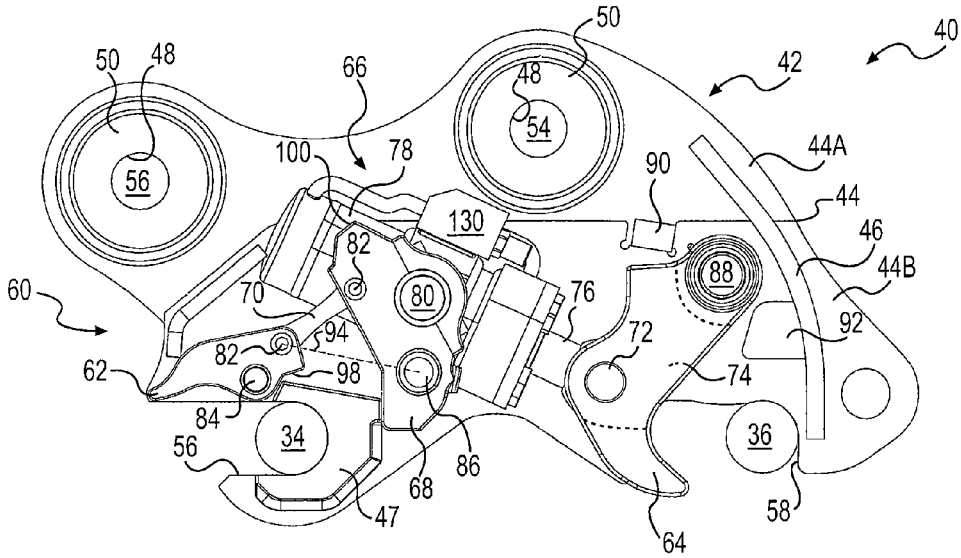
FIG. 4 is cut-away illustration of the tool coupler assembly of FIG. 2 shown in an unlatched position.
Figure 5:
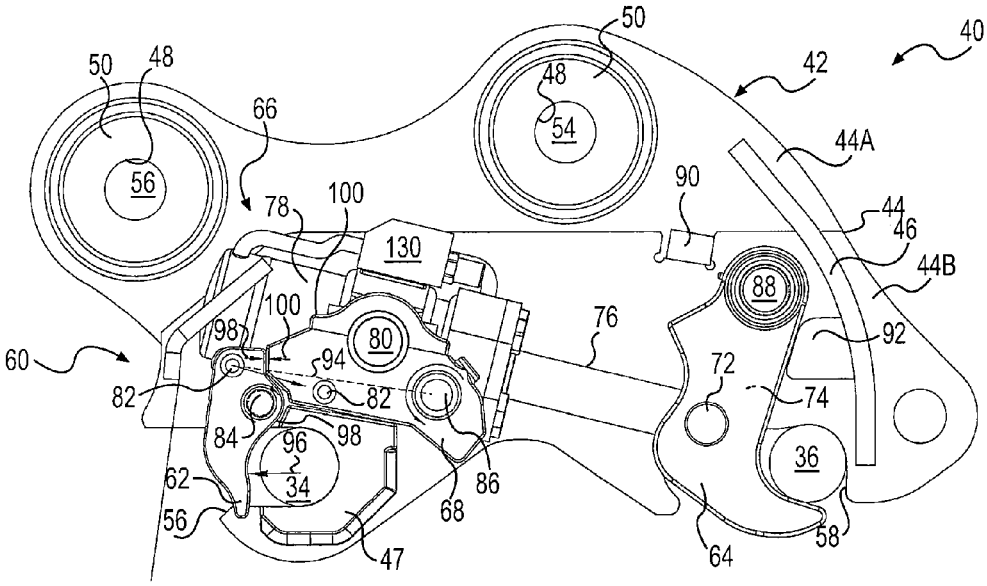
FIG. 5 is cut-away illustration of the tool coupler assembly of FIG. 2 shown in a latched position.

FIGS. 4 and 5 are side views of tool coupler assembly 40 having a side plate member 44 cut away for illustrating a locking system 60 that includes first and second securing hooks or latches 62, 64 for retaining tool pins 34, 36 in notches 56, 58, respectively. FIG. 4 illustrates locking system 60 in an unlocked position, while FIG. 5 illustrates locking system 60 in a locked position. It should be appreciated that a gap may exist between latch 62 and tool pin 34 when locking system 60 is latched or in the locked position.

Locking system 60 may include a number of interconnected components for moving latches 62, 64 between the locked and unlocked positions. For example, locking system 60 may include a hydraulic actuator 66 having a head-end 66A and a rod-end 66B, a pair of rocker assemblies 68 (one located on each side of hydraulic actuator 66), and a pair of connector links 70 pivotally connecting rocker assemblies 68 to opposing sides of latch 62. Latch 64 may have a generally hollow center portion 74 configured to receive a piston rod 76 of hydraulic actuator 66, and a rod pin 72 may pass through corresponding bores formed in opposing sides of latch 64 and in piston rod 76. Rocker assemblies 68 may be pivotally mounted to opposing sides of a tube portion 78 of hydraulic actuator 66 by way of tube pins 80 that extend from the respective sides of tube portion 78 through corresponding bores formed in rocker assemblies 68. First and second link pins 81, 82 may pivotally join connector links 70 at one end to rocker assemblies 68 and at an opposing end to latch 62. Link pins 81 may pass through corresponding bores formed in rocker assemblies 68 and connector links 70, while link pins 82 may pass through corresponding bores formed in latch 62 and connector links 70.

In the exemplary embodiment, locking system 60 may be connected to frame 42 of tool coupler system 40 at multiple locations. First, a latch pin 84 may pass through corresponding bores formed in latch 62 and side plate members 44 for pivotally connecting latch 62 to frame 42. Second, a rocker pin 86 associated with both rocker assembly 68 may pass through corresponding bores formed in each rocker assembly 68 and in each side plate member 44 for pivotally connecting rocker assemblies 68 to frame 42. Third, a latch pin 88 may pass through corresponding bores formed in latch 64 and side plate members 44 for pivotally connecting latch 64 to frame 42.

To unlock latches 62, 64 from tool pins 34, 36, piston rod 76 may retract into tube portion 78 of hydraulic actuator 66. The retracting movement of piston rod 76 may cause latch 64 to pivot in a clockwise direction about latch pin 88, until latch 64 abuts a first end-stop 90 that protrudes from one of side plate members 44. At this point in time, tool pin 36 may be unlocked from tool coupler assembly 40. Continued retraction of piston rod 76 may push latch 64 against end-stop 90 and thereby cause tube portion 78 to be pulled toward latch 64. The pulling of tube portion 78 toward latch 64 may cause rocker assemblies 68 to pivot about rocker pins 86 in a clockwise direction and thereby cause connector links 70 to pivot latch 62 in a clockwise direction about latch pin 84 and away from tool pin 34. At this point in time, tool pin 34 may be unlocked from tool coupler assembly 40.

To lock tool pins 34, 36 in position with latches 62, 64, piston rod 76 may extend from tube portion 78 of hydraulic actuator 66. The extending movement of piston rod 76 may cause latch 64 to pivot in a counterclockwise direction about latch pin 88, until latch 64 engages a second end-stop 92 that protrudes from one of side plate members 44. At this point in time, tool pin 36 may be locked to tool coupler assembly 40. Continued extension of piston rod 76 may push latch 64 against end-stop 92 and thereby cause tube portion 78 to be pushed away from latch 64. The pushing of tube portion 78 away from latch 64 may cause rocker assemblies 68 to pivot about rocker pins 86 in a counterclockwise direction and thereby cause connector links 70 to pivot latch 62 in a counterclockwise direction about latch pin 88 and toward tool pin 34. At this point in time, tool pin 34 may be locked to tool coupler assembly 40.

Locking system 60 may include an over-center feature that helps to prevent latches 62, 64 from unlocking unexpectedly, should hydraulic actuator 66 fail. In particular, when moving from the locked position to the unlocked position, locking system 60 may first rotate latch 62 counterclockwise toward tool pin 34 by a small amount, before rotating latch 62 clockwise away from tool pin 34. This is because link pin 81 may be located below a centerline 94 that extends from link pin 82 to rocker pin 86 when fully locked, and moved through centerline 94 to a point above centerline 94 during the unlocking. Link and rocker pins 82 and 86 may be furthest apart when aligned with centerline 94, and closer together when link pin 81 is either above or below centerline 94. Thus, when link pin 81 is below centerline 94 during clockwise rotation of rocker assemblies 68, connector link 70 may first push latch 62 such that it rotates in the counterclockwise direction. Continued rotation of rocker assemblies 68 may then move link pin 81 above the centerline 94, causing connector link 70 to pull latch 62 such that it rotates in the clockwise direction.

During failure of hydraulic actuator 66, while latches 62, 64 are in the locked position, it may be unlikely for latch 62 to first be inadvertently rotated counterclockwise by an amount sufficient to move link pin 81 past centerline 94, and then fully rotated in the opposite direction to unlock tool pin 34. In fact, an opening force caused by tool pin 34 on latch 62, when latch 62 is in the locked position, may only serve to further secure latch 62. More specifically, an opening force in the direction of an arrow 96 may create a clockwise moment about latch pin 84 that acts on connector link 70 to create a counterclockwise moment about rocker pin 86. Because link pin 81 may be located below centerline 94, the moments about latch and rocker pins 84 and 86 may combine to secure rocker assemblies 68 against cross-brace 47. Accordingly, any force (e.g., an opening force in the direction of arrow 96) that tool pin 34 may apply on latch 62 may actually further secure latch 62 in the locked position.

It should be appreciated that wear from repeated use or warping from heavy loading may alter tool coupler assembly 40 in a manner that inhibits rocker assemblies 68 from properly seating against cross-brace 47. For this reason, latch 62 and rocker assemblies 68 have mating surfaces 98, 100 for securing locking system 60 in the latched position. For example, when locking system 60 is in the latched position, as shown in FIG. 5, the moments about latch and rocker pins 84, 86 may rotate surfaces 98, 100 into abutting contact, thereby securing latch 62 in the locked position. It should also be appreciated that surfaces 98, 100 may be in abutting contact when locking system 60 is in the latched position, even when rocker assemblies 68 are properly seated against cross-brace 47, if desired. These abutting surfaces may provide additional support for keeping latch 62 in the locked position should hydraulic actuator 66 fail.

Figure 6:
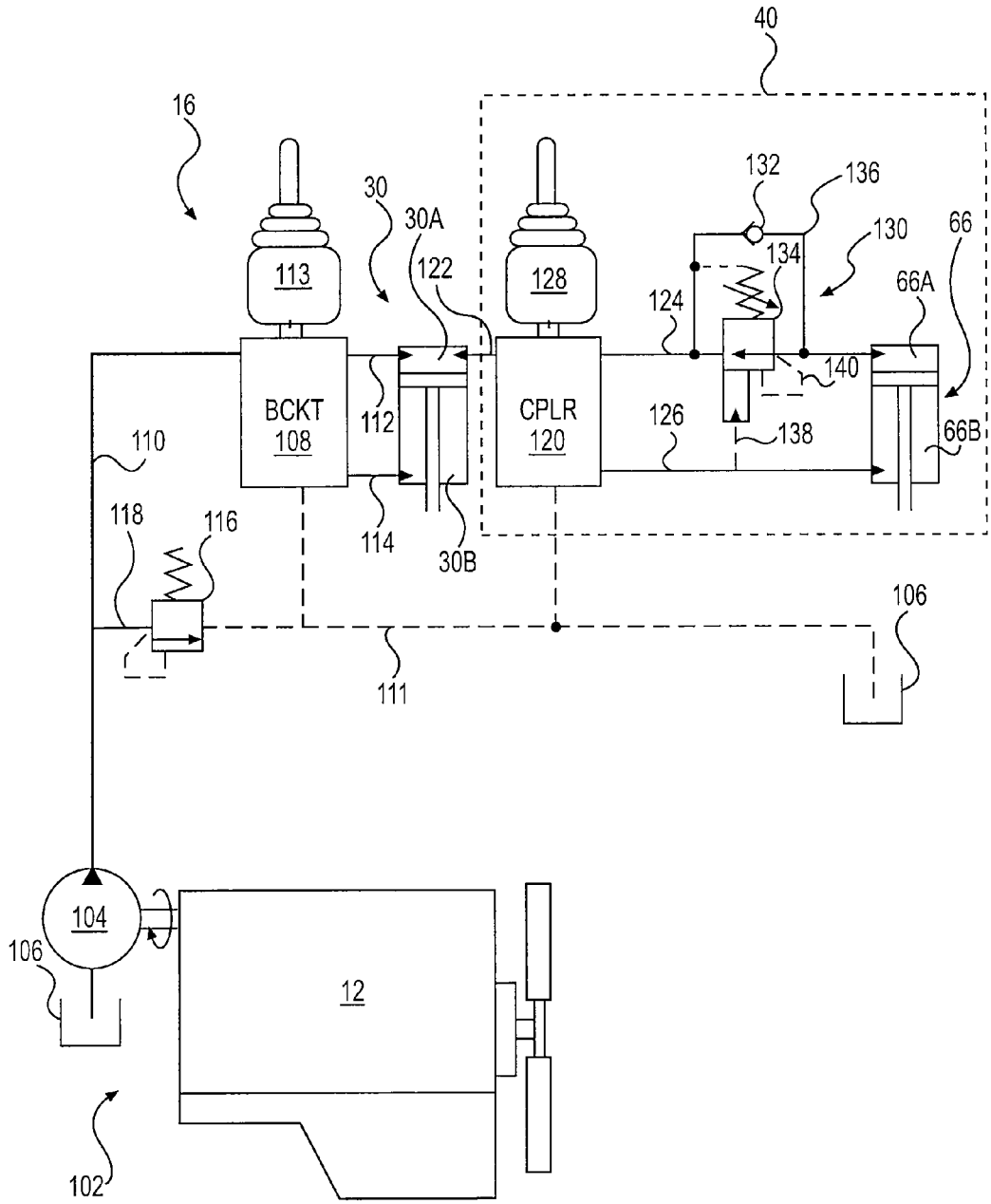
FIG. 6 is a schematic illustration of the machine of FIG. 1.

As can be seen from the schematic of FIG. 6, tool coupler assembly 40 may be part of a hydraulic system 102 that also includes power source 12 and hydraulic cylinder 30. Power source 12 may drive a pump 104 that draws fluid from a low pressure reservoir 106 and pressurizes the fluid for use by hydraulic cylinder 30. A bucket control valve 108 may be located within a supply passage 110, between pump 104 and hydraulic cylinder 30, to affect movement of hydraulic cylinder 30 in response to input received from, for example, an operator interface device 113 located within operator station 16.

Bucket control valve 108 may regulate operation of hydraulic cylinder 30 and, thus, the motion of tool 18 relative to stick member 24. Specifically, bucket control valve 108 may have elements movable to control a flow of pressurized fluid from pump 104 to head-end 30A and rod-end 30B of hydraulic cylinder 30, and from the head- and rod-ends 30A, 30B to reservoir 106 via a drain passage 111. In response to a command from operator interface device 113 to extend hydraulic cylinder 30, the elements of bucket control valve 108 may move to allow the pressurized fluid from pump 104 to enter and fill head-end 30A of hydraulic cylinder 30 via supply passage 110 and a head-end passageway 112, while simultaneously draining fluid from rod-end 30B of hydraulic cylinder 30 to reservoir 106 via a rod-end passage 114 and drain passage 111. In response to a command from operator interface device 113 to retract hydraulic cylinder 30 and thereby curl tool 18 toward stick member 24, the elements of bucket control valve 108 may move to allow pressurized fluid from pump 104 to enter and fill rod-end 30B of hydraulic cylinder 30 via supply passage 110 and rod-end passage 114, while simultaneously draining fluid from head-end 30A of hydraulic cylinder 30 to reservoir 106 via head-end passage 112 and drain passage 111.

During extension and retraction of hydraulic cylinder 30, hydraulic cylinder 30 and/or tool 18 may reach an end-stop position (shown in FIG. 1) past which further movement may be inhibited. Once the end-stop position has been reached, further attempts to move hydraulic cylinder 30 in the same direction may only function to build pressure within supply passage 110 and the expanded chamber of hydraulic cylinder 30. To help avoid excessive and damaging pressure spikes within hydraulic system 102, a pressure relief valve 116 may be located within a bypass passage 118 that connects supply passage 110 to drain passage 111. Pressure relief valve 116 may be configured to open and allow a flow of pressurized fluid from supply passage 110 to drain passage 111 when a pressure within supply passage 110 exceeds a limit pressure. In one example, the limit pressure may be in the range of about 4,000-6,000 psi.

Tool coupler assembly 40 may be connected to receive pressurized fluid from hydraulic cylinder 30. More particularly, a coupler control valve 120 associated with tool coupler assembly 40 may include a supply passage 122 fluidly connected to head-end 30A of hydraulic cylinder 30. Coupler control valve 120 may, in turn, be connected to head- and rod-ends 66A, 66B of hydraulic actuator 66 by way of head- and rod-end passages 124, 126, respectively. Coupler control valve 120 may also be connected to drain passage 111. In this manner, based on input received from an operator interface device 128 located within operator station 16, coupler control valve 120 may selectively direct pressurized fluid from hydraulic cylinder 30 to either head- or rod-end 66A, 66B via supply passage 122, while simultaneously draining fluid from the other of head- or rod-end 66A, 66B to reservoir 106 via drain passage 111 to cause hydraulic actuator 66 to move. Hydraulic actuator 66 may be extended and retracted in a manner similar to that described above with respect to hydraulic cylinder 30.

A pressure valve 130 may be located within head-end passage 124 to regulate the filling and draining of head-end 66A of hydraulic actuator 66. Pressure valve 130 may include a check element 132 and a pressure regulating element 134. Check element 132 may be located within a bypass passage 136 that allows fluid to selectively bypass pressure regulating element 134. Check element 132 may be movable to only allow fluid into head-end 66A of hydraulic actuator 66 based on a pressure of fluid within head-end 66A. That is, when a pressure of fluid within head-end passage 124 at a location upstream of pressure regulating element 134 (i.e., when a pressure of fluid received from head end 30A of hydraulic cylinder 30) is greater than a pressure of fluid within head-end passage 124 at a location downstream of pressure regulating element 134 (i.e., greater than a pressure of fluid within head-end 66A of hydraulic actuator 66), fluid may flow past check element 132 into head-end 66A.

Pressure regulating element 134 may selectively allow fluid from within head-end 66A of hydraulic actuator 66 to drain to reservoir 106 via coupler control valve 120, based on a pressure within rod-end 66B of hydraulic actuator 66. That is, pressure regulating element 134 may be a spring-biased, pilot-operated valve that is movable between a first position at which fluid flow out of head-end 66A is inhibited, and a second position at which fluid flow out of head-end 66A is allowed. Pressure regulating element 134 may include a pilot passage 138 in communication with rod-end passage 126, and be moved from the first position toward the second position when a pressure of fluid within rod-end passage 126 (i.e., when a pressure of fluid within rod-end 66B) exceeds a first set threshold pressure. In one example, the first set threshold pressure may be in the range of about 2,000-6,000 psi. In one example, the first set threshold pressure may be about the same pressure setting as pressure relief valve 116.

Because the first set threshold pressure of pressure regulating element 134 may be somewhat elevated compared to a normal operating pressure of tool system 14, fluid may only be drained from head-end 66A of hydraulic actuator 66 when pressure relief valve 116 is about to or has already opened to relieve pressure within supply passage 110. That is, 2,000-6,000 psi, which may be required to move pressure regulating element 134 to the second or flow-passing position, may only be developed within head-end 30A of hydraulic cylinder 30 after hydraulic cylinder 30 has been moved to its end-stop position and further manipulated. In some situations, this may be at about the same time that pressure relief valve 116 opens. For this reason, an operator may be required to first fully curl tool 18 (i.e., fully extend hydraulic cylinder 30) and continue manipulation in the curling direction for a period of time after reaching the end stop (e.g., for about 5-10 seconds after reaching the end stop), before hydraulic actuator 66 and tool coupler assembly 40 may be able to fully decouple tool 18 from stick member 24. In this manner, a desired tool position (i.e., full tool curl) and a desired operational pressure (about 2,000-6,000 psi) may be ensured prior to allowing tool decoupling.

Pressure regulating element 134 may help reduce the likelihood of pressure spikes damaging hydraulic actuator 66. That is, pressure regulating element 134 may be further configured to allow fluid to exit head-end 66A of hydraulic actuator 66 based on a pressure of fluid within head-end 66A of hydraulic actuator 66. In particular, a pilot passage 140 may communicate pressurized fluid from a location downstream of pressure regulating element 134 (i.e., a pressure within head-end 66A) to pressure regulating element 134 to move pressure regulating element 134 toward the second or flow-passing position when a pressure within head-end 66A exceeds a second set threshold pressure. In one example, this second threshold pressure may be about 6,000 psi.

Figure 7:
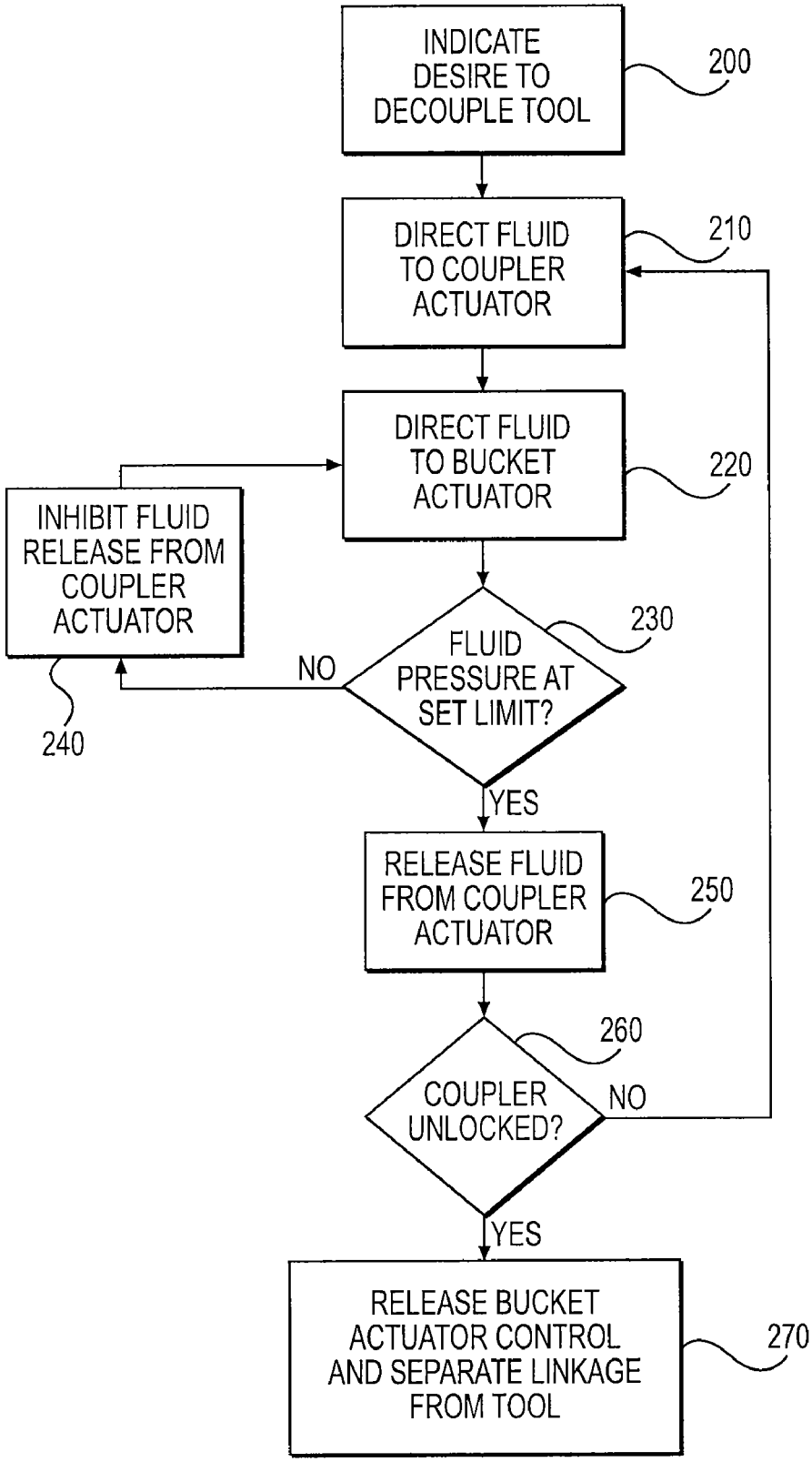
FIG. 7 is a flowchart depicting an exemplary disclosed method that may be employed during operation of the tool coupler assembly of FIG. 2.
Figure 8:
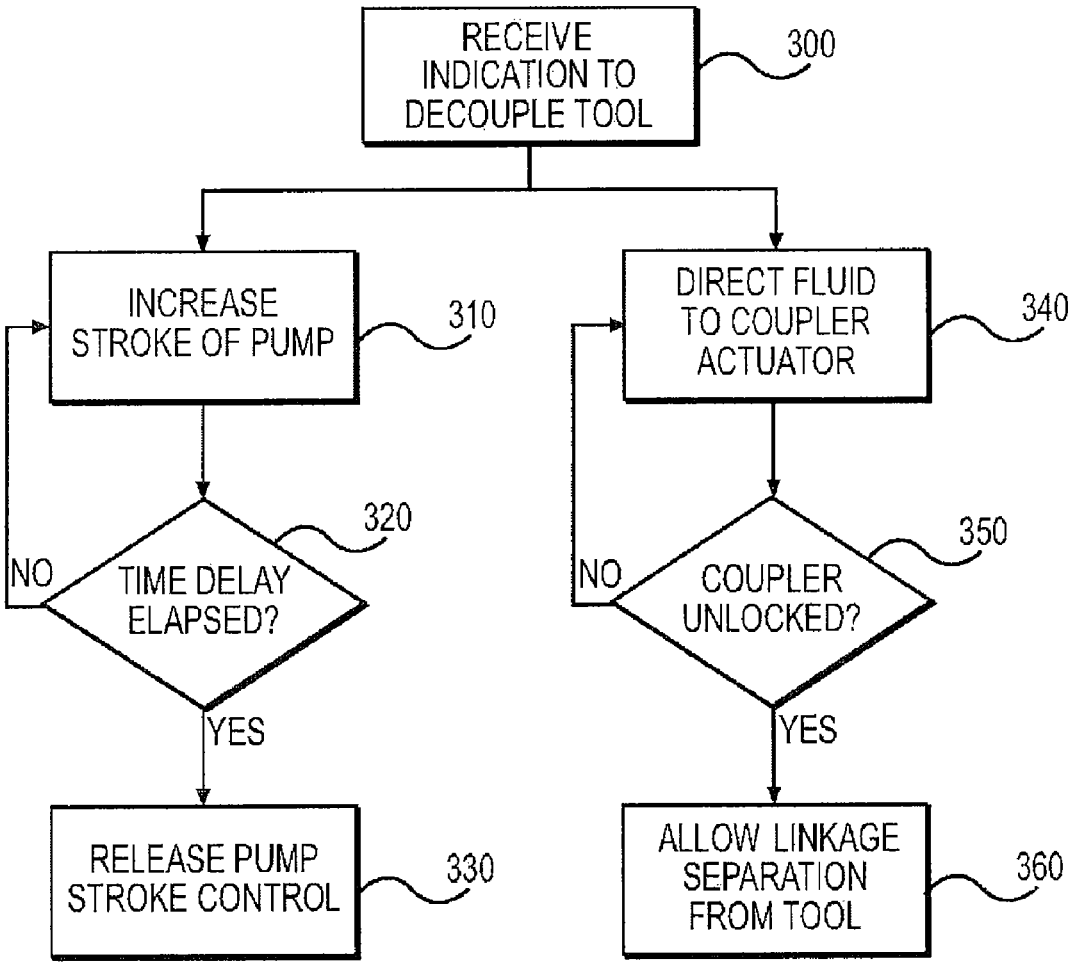
FIG. 8 is a flowchart depicting another exemplary disclosed method that may be employed during operation of the tool coupler assembly of FIG. 2.

FIGS. 7 and 8 illustrate exemplary methods used to decouple tool 18 from machine 10. These methods will be explained in more detail in the follow section to better illustrate the disclosed system and its operation.

INDUSTRIAL APPLICABILITY

The presently disclosed tool coupler assembly may be applicable to a variety of machines, such as excavators, backhoes, loaders, and motor graders, to increase the functionality of these machines. For example, a single excavator may be used for moving dirt, rock and other material, and during the excavation operations, different implements may be required such as a different size of bucket, an impact breaker, or a grapple. The disclosed tool coupler assembly can be used to quickly change from one implement to another with ease, thus reducing the time the machine is unavailable for its intended purpose.

In operation, tool coupler assembly 40 may first be attached to stick member 24 of machine 10. To achieve this attachment, an end of stick member 24 and an end of power link 31 may be maneuvered between side plate members 44 and in alignment with pin openings 48. Stick pins 52 and 54 may then be inserted into pin openings 48 to connect stick member 24 and power link 31, respectively, to an upper portion of tool coupler assembly 40. Locking pins (not shown) may then be inserted through collars 50 and corresponding slots within stick pins 52 and 54, if desired, to lock stick pins 52 and 54 in place. In this manner, tool coupler assembly 40 may be securely attached to an end of stick member 24 throughout machine operation.

To attach a tool 18 to tool coupler assembly 40, stick member 24 may be maneuvered to a position at which a bottom portion of tool coupler assembly 40 is above tool 18. Tool coupler assembly 40 may be oriented so that notch 56 is located to receive tool pin 34. Tool coupler assembly 40 may then be lowered onto tool 18 so that tool pin 34 is seated within notch 56. Hydraulic cylinder 30 may next be activated to move power link 31 and thereby pivot tool coupler assembly 40 about tool pin 34 such that notch 58 may be moved over tool pin 36. Tool pin 36 may then be seated within notch 58.

To lock tool pins 34, 36 within notches 56, 58, hydraulic actuator 66 may be activated to extend piston rod 76. As described above, the extension of piston rod 76 may first cause latch 64 to rotate counterclockwise and close on tool pin 36 until end stop 92 is engaged, with further extension of piston rod 76 resulting in translation of tube portion 78 away from tool pin 36 and a corresponding counterclockwise rotation of rocker assemblies 68. The rotation of rocker assemblies 68 may cause a corresponding translation of connector links 70, and the counterclockwise rotation of latch 62 against tool pin 34. Once link pin 81 has moved below centerline 94, both of tool pins 34 and 36 may be locked in position.

FIG. 7 illustrates an exemplary process that may be followed to decouple tool 18 from tool coupler assembly 40. To initiate decoupling of tool 18, an operator may provide an indication of a desire to decouple tool 18 by, for example, manipulating interface device 128 (Step: 200). When interface device 128 is manipulated, pressurized fluid may be directed from head-end 30A of hydraulic cylinder 30 to rod-end 66B of hydraulic actuator 66 (Step: 210). At about this same time, after manipulation of interface device 128, the operator may also manipulate interface device 113 to place tool 18 in a desired position. In one example, the desired position is the fully-curled position shown in FIG. 1.

To place tool 18 in the fully-curled position, pressurized fluid may be directed from pump 104 to hydraulic cylinder 30 via bucket control valve 108 (Step: 220). Pressurized fluid may continue to be directed to hydraulic cylinder 30 until an end-stop position is achieved and the pressure within head-end 30A of hydraulic cylinder 30 has reached a set limit of about 2,000-6,000 psi (Step: 230). Until the set pressure limit within head-end 30A has been reached, hydraulic actuator 66 may be hydraulically locked and inhibited from releasing fluid that would allow hydraulic actuator 66 to move (Step: 240).

Once the set pressure limit within head-end 30A of hydraulic cylinder 30 has been reached, the pressurized fluid from head-end 30A may move pressure regulating element 134 to the flow-passing position, thereby releasing fluid from and hydraulically unlocking actuator 66 (Step: 250). By releasing fluid from head-end 66A of hydraulic cylinder 60, the pressurized fluid entering rod-end 66B from head-end 30A of hydraulic cylinder 30 may cause piston rod 76 to retract relative to tube portion 78. Such retraction may rotate latch 64 away from tool pin 36 until latch 64 contacts end-stop 90. Once latch 64 contacts end-stop 90, the retracting piston rod 76 may pull tube portion 78, including rocker assemblies 68 connected thereto, toward latch 64. The rotating rocker assemblies 68 may move links 70 out of the over-center position, causing latch 62 to rotate away from tool pin 34.

Steps 220-250 may be repeated until latches 62, 64 of tool coupler assembly 40 are unlocked (Step: 260). Unlocking may be confirmed visually by an operator of machine 10. Alternatively, a sensor (not shown) may be associated with one or both of latches 62, 64, if desired, to provide the desired confirmation. After confirmation of latch unlocking, bucket actuator control may be released, and stick member 24 and tool coupler assembly 40 may be separated from tool 18 for connection to another tool, if desired (Step: 270).

The exemplary process illustrated in FIG. 8 may be less manual than the process of FIG. 7. In particular, in response to receiving an operator input indicative of a desired tool uncoupling (Step: 300), a controller (not shown) may directly increase an effective stroke of pump 104 (Step 310). The increasing of pump stroke may continue until a set period of time has elapsed (Step 320) such that a desired pressure within hydraulic system 102 may be generated. After the set period of time has elapsed, pump stroke control may be released (Step 330).

At about the same time as increasing pump stoke, pressurized fluid from pump 104 may be directed to hydraulic actuator 66 (340). Once the pressure of the fluid from pump 104 reaches the set limit of pressure-regulating element 134, pressure-regulating element 134 may move to the flow-passing position to release fluid from and hydraulically unlock actuator 66. Pressurized fluid directed to rod-end 66B, after the hydraulic unlocking, may function to retract hydraulic actuator 66 and thereby unlock tool coupler assembly 40, as described above with respect to the method of FIG. 7 (Step: 350). After confirmation of latch unlocking, stick member 24 and tool coupler assembly 40 may be separated from tool 18 for connection to another tool, if desired (Step: 360).

The presently disclosed tool coupler assembly may help ensure proper coupling and decoupling of tool 18, while providing pressure spike protection to the assembly. In particular, the disclosed tool coupler assembly may require movement of tool 18 to a desired position (i.e., full curl as shown in FIG. 1) before decoupling can begin. In addition, pressure regulating element 134 of pressure valve 130 may reduce the likelihood of pressure spikes within head-end 66A of hydraulic actuator 66 from becoming excessive enough to be damaging.

It will be apparent to those skilled in the art that various modifications and variations can be made to the tool coupler assembly of the present disclosure without departing from the scope of the disclosure. Other embodiments will be apparent to those skilled in the art from consideration of the specification and practice of the tool coupler assembly disclosed herein. For example, although the disclosed tool coupler assembly is shown as having two movable latches and a hydraulic cylinder configured to move both latches, it may also be possible for only one of the latches to be movable by the hydraulic cylinder and the remaining latch to be fixed to the frame of the tool coupler assembly, if desired. It is intended that the specification and examples be considered as exemplary only, with a true scope of the disclosure being indicated by the following claims and their equivalent.

We claim:

1. A tool coupler assembly, comprising:
- a coupler frame;
- a first latch connected to the coupler frame;
- a second latch connected to the coupler frame;
- a hydraulic actuator connected to move the second latch relative to the first latch and the coupler frame, the hydraulic actuator having:
  - a first chamber;
  - a second chamber separated from the first chamber;
  - a first port in fluid communication with the first chamber; and
  - a second port in fluid communication with the second chamber;
- a pressure valve having a check element movable to allow a flow of fluid into the first chamber via the first port based on a pressure of fluid in the first chamber, and a pressure-regulating element movable to allow a flow of fluid out of the first chamber via the first port based on a pressure of fluid in the second chamber; and
- a first pilot passage configured to communicate fluid from the second chamber with the pressure-regulating element to move the pressure-regulating element; and
- a second pilot passage configured to communicate fluid from the first chamber with the pressure-regulating element to move the pressure-regulating element.

2. The tool coupler assembly of claim 1, wherein the pressure-regulating element is spring biased.

3. The tool coupler assembly of claim 1, wherein the pressure-regulating element is configured to allow fluid out of the first chamber when a pressure of fluid in the second chamber is a first pressure, and to all fluid out of the first chamber when a pressure of the fluid in the first chamber is a second pressure different than the first pressure.

4. The tool coupler assembly of claim 3, wherein the first pressure is about 4,000 psi.

5. The tool coupler assembly of claim 3, wherein the second pressure is about 6,000 psi.

6. The tool coupler assembly of claim 1, wherein the hydraulic actuator is a cylinder, the first port is a head-end port, and the second port is a rod-end port.

7. The tool coupler assembly of claim 1, further including a control valve configured to selectively direct fluid to and from the first and second chambers of the hydraulic actuator.

8. The tool coupler assembly of claim 1, wherein the first and second latches are pivotal relative to the coupler frame, and the hydraulic actuator is configured to move both the first and second latches.

9. The tool coupler assembly of claim 8, further including an over-center rocker assembly pivotally connected to the hydraulic actuator and to the first latch.

10. The tool coupler assembly of claim 9, wherein the over-center rocker assembly is pivotally connected to a tube portion of the hydraulic actuator, and a piston rod of the hydraulic actuator is connected to the second latch.

11. A machine, comprising:

a base frame;

linkage movable relative to the base frame;

a first hydraulic cylinder connected to move the linkage;

a tool having a first pin and a second pin; and a tool coupler assembly configured to connect the tool to the linkage, the tool coupler assembly including:

a coupler frame;

a first latch connected to the coupler frame and configured to engage the first pin of the tool;

a second latch connected to the coupler frame and configured to engage the second pin of the tool;

a second hydraulic cylinder connected to move the second latch relative to the first latch and the coupler frame;

a control valve configured to selectively direct fluid from the first hydraulic cylinder to the second hydraulic cylinder and from the second hydraulic cylinder to a low pressure reservoir; and a pressure valve configured to allow fluid into and out of the second hydraulic cylinder based on fluid pressures in the second hydraulic cylinder.

12. The machine of claim 11, wherein the pressure valve is configured to allow fluid into a head-end of the second hydraulic cylinder based on a pressure of fluid in the head-end, and to allow fluid out of the head-end based on a pressure of fluid in a rod-end of the second hydraulic cylinder.

13. The machine of claim 12, wherein the pressure valve includes:

a check element movable to allow a flow of fluid into the head-end; and a pressure-regulating element movable to allow a flow of fluid out of the head-end.

14. The machine of claim 13, wherein the pressure-regulating element is spring biased and pilot operated.

15. The machine of claim 14, wherein the pressure-regulating element is configured to allow fluid out of the head-end when a pressure of fluid in the rod-end exceeds about 4,000 psi.

16. The machine of claim 15, wherein the pressure-regulating element is further configured to allow fluid out of the head-end when a pressure of fluid in the head-end exceeds about 6,000 psi.

17. The machine of claim 11, wherein the first and second latches are pivotal relative to the coupler frame, and the second hydraulic cylinder is configured to move both the first and second latches.

18. The machine of claim 17, further including an over-center rocker pivotally connected to a tube portion of the second hydraulic cylinder and to the first latch, wherein a piston rod of the second hydraulic cylinder is pivotally attached to the second latch.

* * * * *